United States Patent [19]

Sevcik et al.

[11] 4,175,474

[45] Nov. 27, 1979

[54] VARIABLE DISPLACEMENT PUMP

[75] Inventors: Ladislav Sevcik, Chrastava; Josef Dvorak; Jiri Mlynar, both of Liberec, all of Czechoslovakia

[73] Assignee: Elitex, Koncern textilniho strojirenstvi, Liberec, Czechoslovakia

[21] Appl. No.: 851,784

[22] Filed: Nov. 15, 1977

[30] Foreign Application Priority Data

Dec. 13, 1976 [CS] Czechoslovakia ..... 8109/76

[51] Int. Cl.[2] ..... F01B 31/14; F15B 15/24

[52] U.S. Cl. ..... 92/13.5; 92/13.7

[58] Field of Search ..... 417/218; 92/13.5, 13.6, 92/13.7, 13.8

[56] References Cited

U.S. PATENT DOCUMENTS

| | | | |
|---|---|---|---|
| 1,649,356 | 11/1927 | Louis | 92/13.7 X |
| 1,824,467 | 9/1931 | Darby et al. | 92/13.7 X |
| 2,147,989 | 2/1939 | Puurmann | 92/13.7 X |
| 2,792,156 | 5/1957 | Camp | 92/13.7 |
| 2,898,867 | 8/1959 | Saalfrank | 92/13.7 X |
| 3,901,231 | 8/1975 | Olson | 92/13.7 X |

*Primary Examiner*—William L. Freeh
*Assistant Examiner*—Edward Look

[57] ABSTRACT

Variable displacement cam driven piston pump having means for the stepless adjustment of the length of the pump stroke. The stroke adjusting means has pivotally mounted spaced parallel levers, the levers being interposed between the cam and the piston of the pump, the levers being mutually coupled in their movement by a means adjustably arranged along the length of said levers, said levers being disposed on the opposite sides of a plane defined by the contact points between the lever coupling means and the levers.

4 Claims, 4 Drawing Figures

VARIABLE DISPLACEMENT PUMP

The present invention relates to a variable displacement cam driven piston pump having means for the stepless adjustment of the length of the piston's stroke. The pump of the invention may be advantageously employed for the feeding of liquid to the nozzle of a jet loom.

In piston pumps used in hydraulic jet looms, the stroke and thus the quantity of liquid fed to the nozzle are adjusted by changing the position of a stop cooperating with a piston. Such stop may be used, however, only with piston pumps having a spring drive, the main disadvantage of which is the breakage of the driving springs, which are highly stressed. In cam-operated pumps such as the fuel injection pumps for internal combustion engines, the effective length of the stroke of the piston of the pump and thus the quantity of injected liquid is changed by turning the piston, which is provided with a helical groove through which excess liquid is discharged or bled to the sump.

The disadvantage of changing the effective length of the stroke of a piston pump in such manner is that with the change of the effective length of the piston stroke the time interval of liquid feeding is also changed; such result is undesirable in pumps employed in jet looms.

The above-mentioned disadvantages and shortcomings of prior variable displacement cam driven piston pumps are mitigated by the pump of the invention, wherein there is employed a device for the stepless adjustment of the length of the pump stroke. The stroke adjusting means in the pump of the invention has pivotally mounted spaced generally parallel levers, the levers being interposed between the eccentric such as a cam and the piston of the pump. The levers are mutually coupled in their movement by a means adjustably arranged along the length of the levers, the levers being disposed on the opposite sides of a plane defined by the points of contact between the lever coupling means and the levers.

Further advantages and features of the present invention are illustrated in the exemplary embodiments which are diagrammatically shown in the accompanying drawings, in which.

Figure 1:
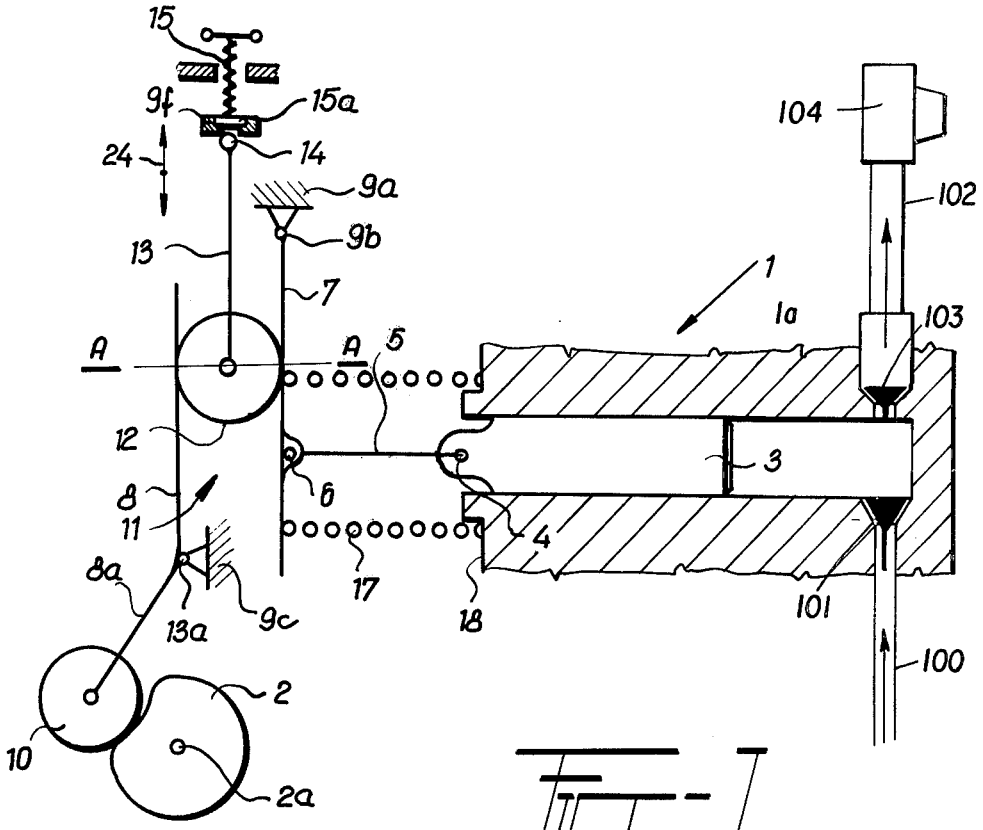
FIG. 1 is a front view of a first embodiment of the means for the stepless adjustment of the length of the stroke of the piston of the pump of the present invention.

Turning now to FIG. 1, there is there shown a piston pump 1 the piston 3 of which is reciprocably mounted in a cylinder 1*a* and is driven by a cam 2 fixedly mounted on a rotatable shaft 2*a* which is driven, for example, from the main shaft of a jet loom. As shown, liquid is supplied to the space within the cylinder 1*a* beyond the right hand end of the piston 3 through a supply pipe 100 and is delivered under pressure therefrom through a delivery port and a delivery conduit 102 leading to a nozzle 104 of a jet loom upon the movement of the piston 3 to the right. A check valve 101 permits the entry of feed fluid into the cylinder through the pipe 100 and a check valve 103 prevents the escape of fluid from the line 102 and the jet nozzle 104 into the cylinder. A schematically shown piston rod 5 is pivotally connected at 4 to the left hand end of the piston 3 and at 6 to a first lever 7 which is pivotally connected at 9*b* to a fixed support 9*a*. A coil compression spring 17 interposed between the left hand end of the cylinder 1*a* and the lever 7 constantly urges such lever in a clockwise direction around the pivot 9*b*. A bell crank having a first arm 8 in the form of a lever parallel to lever 7 is pivotally mounted at the junction between its two arms 8 and 8*a* by a joint 9*d* mounted upon a fixed support 9*c*. A cam following roller 10, rotatably mounted upon the lower end of the arm 8*a* of the bell crank, constantly engages the outer surface of the driving cam 2.

Interposed between the levers 7 and 8 is a roller 12 which is of such diameter that the levers 7 and 8 are parallel, as shown. Roller 12 is rotatably mounted upon an axle 13*a* which is connected to the lower end of an adjusting rod 13 which is suspended from a fixed support 9*f* for adjustment along its length as indicated by the double ended arrow 24.

Rod 13, and thus the roller 12, are adjusted along the lengths of the levers 7 and 8 by an adjusting screw 15 which is mounted in a nut 15*a* carried by the support 9*f*. The lower end of the screw 15 is rotatably connected to the upper end of the rod 13 through a pivot joint 14. It will be apparent that upon turning the screw 15 in opposite directions the roller 12 is displaced up and down, respectively, thereby altering the angular extent of oscillation of the lever 7, and thus the length of stroke imparted thereby to the piston 3. It will be seen that the levers 7, 8 are arranged in such manner that their axes of rotation are disposed on opposite sides of the plane A—A which extends through the respective points of contact between the levers 7 and 8 and the roller 12.

Figure 2:
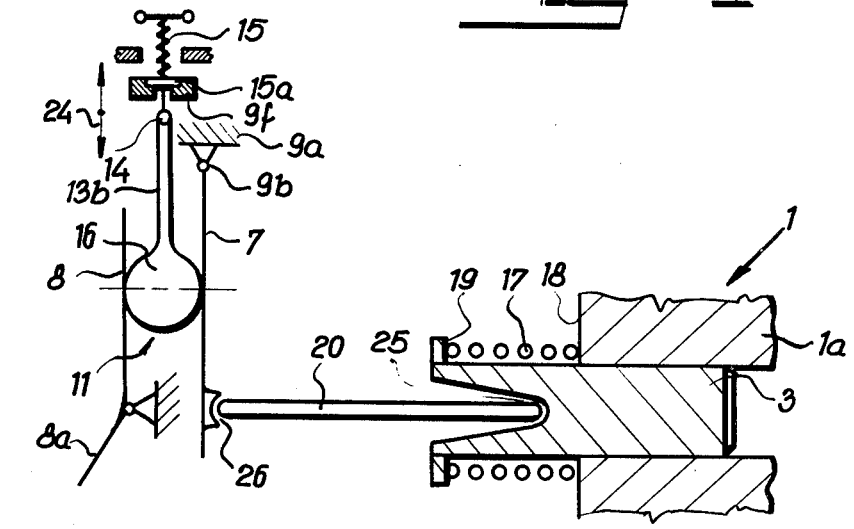
FIG. 2 is a front view of a second embodiment of the means for the stepless adjustment of the length of the stroke of the piston of the present invention.

In FIG. 2 there is fragmentarily shown a second embodiment of the means for the stepless adjustment of the length of the stroke of the cam driven pump. Parts in FIG. 2 which are similar to those in FIG. 1 are designated by the same reference characters. The embodiment of FIG. 2 differs from that of FIG. 1 in that the coil compression spring 17, which returns the piston 3 to the left, is disposed between the left hand face of the cylinder 1*a* and the flange 19 affixed to the left hand end of the piston. Connection between the lever 7 and the piston 3 is effected by a rod 20 the right end of which is pivotally received within an open ended socket 25 in the left hand end of the piston and the right hand end of which is pivotally received within a socket 26 affixed to the lever 7. The levers 7 and 8 are coupled by a generally cylindrical member 16 disposed between and contacting them, member 16 having a vertical rod-like stem 13*b* the upper end of which is connected to the pivotal joint 14.

Figure 3:
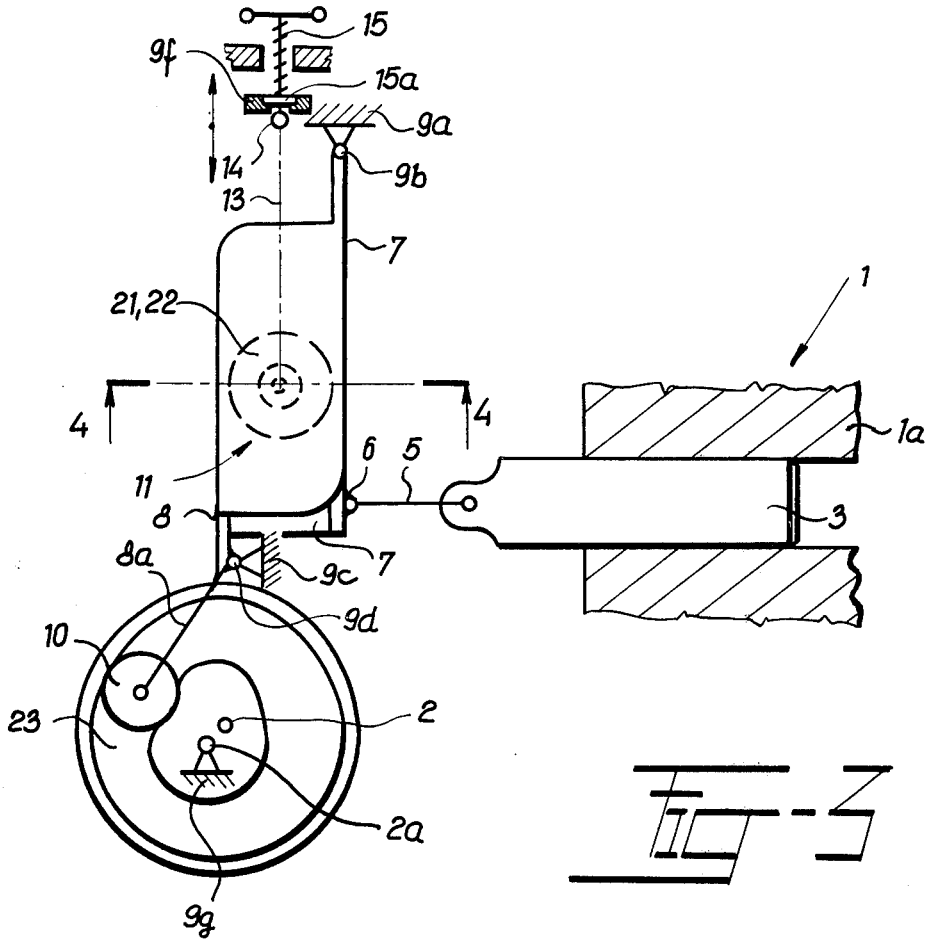
FIG. 3 is a front view of a third embodiment of the means for the stepless adjustment of the length of the stroke of the piston in the pump of the present invention.
Figure 4:
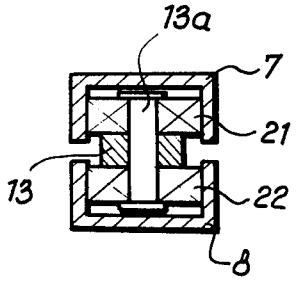
FIG. 4 is a view in section through the apparatus of FIG. 3, the section being taken along the line 4—4 in FIG. 3.

The third illustrative embodiment of the means for the stepless adjustment of the piston of the pump is shown in FIGS. 3 and 4. Parts in FIGS. 3 and 4 which are the same as or similar to those shown in FIGS. 1 and 2 are designated by the same reference characters.

In this embodiment the cam 2 is a box cam having radially spaced radially inner and outer cam surfaces presenting a cam track 23. The cam following roller 10 runs in track 23 and positively oscillates the lever 8 in both directions. As shown in FIG. 4 the levers 7 and 8 are of U cross section, and the means coupling the levers 7 and 8 are constituted by a pair of rollers 21 and 22 rotatably mounted upon an axle 13*a* which is connected to the lower end of the rod 13. As in the embodiments of FIGS. 1 and 2, the lever 8 of FIGS. 3 and 4 is pivotally mounted at its top at 9*b* and the lever 8 is pivotally mounted at its bottom on a pivot 9*d*.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In a variable delivery fluid pump adapted for the feeding of liquid to the nozzle of a jet loom, the pump having a cylinder, a piston which reciprocates in the cylinder, said piston having a piston rod the outer free end of which extends outside an end of the cylinder, and a piston driving means including a driven eccentric means for reciprocating the piston, the improved piston driving means which comprises first and second generally parallel levers disposed outwardly of the outer free end of the piston rod, the levers extending at a substantial angle with respect to the path of reciprocation of the piston, means for pivotally mounting each of the levers for oscillation toward and away from the cylinder, the first lever being disposed nearer the cylinder and being drivingly connected to the outer end of the piston rod, the second lever being disposed further from the cylinder and coacting with the eccentric means so as to be oscillated thereby, and means mounted for adjustment along the length of the levers coupling them for joint oscillatory movement, adjustment of the last named means along the lengths of the levers changing the transmission ratio of both levers.

2. A pump as claimed in claim 1, wherein the means coupling the levers comprises a roller mounted between the pair of levers on a pivot pin which is mounted for adjustment along the length of the levers.

3. A pump as claimed in claim 1, wherein each of the levers is generally of U-shaped cross section, and has spaced parallel flanges, and the means coupling the levers comprises a pair of similar coaxial rollers journaled on the pivot pin, the rollers being disposed within the spaces presented within the respective levers, each roller engaging the opposite flanges of its respective lever.

4. A pump as claimed in claim 1, wherein the eccentric means is a cam, and comprising a cam follower on the second lever, and wherein the cam thrusts the piston rod in the working stroke of the piston, an open socket in each of the piston and the first lever, the piston rod being mounted with its opposite ends in the respective sockets, and resilient means constantly maintaining the piston rod in compression between said sockets, and the cam follower on the second lever in engagement with the cam.

* * * * *